US006387197B1

(12) United States Patent
Bewlay et al.

(10) Patent No.: US 6,387,197 B1
(45) Date of Patent: May 14, 2002

(54) TITANIUM PROCESSING METHODS FOR ULTRASONIC NOISE REDUCTION

(75) Inventors: Bernard Patrick Bewlay, Schenectady; Michael Francis Xavier Gigliotti, Jr., Scotia, both of NY (US); David Ulrich Furrer, South Milwaukee, WI (US); Gangshu Shen, Oak Creek, WI (US); Jacek Marian Franczak, New Berlin, WI (US)

(73) Assignees: General Electric Company, Schenectady, NY (US); Ladish Company, Inc., Milwaukee, WI (US)

( * ) Notice: Subject to any disclaimer, the term of this patent is extended or adjusted under 35 U.S.C. 154(b) by 0 days.

(21) Appl. No.: 09/481,109

(22) Filed: Jan. 11, 2000

(51) Int. Cl.[7] ..... C22F 1/18

(52) U.S. Cl. ..... 148/669; 148/670; 148/671; 148/421

(58) Field of Search ..... 148/669, 670, 148/671, 421

(56) References Cited

U.S. PATENT DOCUMENTS 5,039,356 A * 8/1991 Weiss et al. ..... 148/421
5,277,718 A * 1/1994 Paxson et al. ..... 148/671
6,190,473 B1 * 2/2001 Martin ..... 148/671

OTHER PUBLICATIONS

The Journal of The Acoustical Society of America, Revised Grain–Scattering Formulas and Tables, Emmanuel P. Papadakis, vol. 37, No. 4, pp. 703–710, Apr. 1965.
The Journal of The Acoustical Society of America, Ultrasonic Attenuation Caused by Scattering in Polycrystalline Metals, Emmanuel P. Papadakis, vol. 37, No. 4, pp. 711–717, Apr. 1965.

* cited by examiner

*Primary Examiner*—John Sheehan
*Assistant Examiner*—Andrew L. Oltmans
(74) *Attorney, Agent, or Firm*—Robert P. Santandrea; Noreen C. Johnson

(57) ABSTRACT

A method is set forth for processing titanium and titanium alloys into titanium articles, in which the titanium exhibits enhanced ultrasonic inspection results for determining its acceptability in microstructurally sensitive titanium applications. The method for processing titanium comprises providing titanium at a temperature above its β-transus temperature; quenching the titanium from a temperature above the β-transus temperature, the step of quenching titanium forming an α-plate microstructure in the titanium; and deforming the quenched titanium into a titanium article, the step of deforming the quenched titanium transforming the α-plate microstructure into discontinuous α particles without crystallization textures. The discontinuous-randomly textured α particles lead to a reduction in ultrasonic noise during ultrasonic inspection.

19 Claims, 3 Drawing Sheets

TITANIUM PROCESSING METHODS FOR ULTRASONIC NOISE REDUCTION

BACKGROUND OF THE INVENTION

The invention relates to methods for ultrasonic noise reduction in titanium-containing materials. In particular, the invention relates to methods for ultrasonic noise reduction in titanium alloy forgings.

Nondestructive evaluation by ultrasonic inspection and ultrasonic inspection testing is a known material testing and evaluation method. Ultrasonic testing typically requires that items to be detected possess high acoustic reflectance behaviors from bulk material under ultrasonic inspection. This different behavior permits the ultrasonic inspection technique to detect flaws, large and/or abnormal grains, imperfections, and other related microstructural characteristics for a material.

Materials with large, elastically anisotropic grains, such as, but not limited to, cast ingots of steels, titanium alloys, and nickel alloys, are often difficult to evaluate by ultrasonic testing. The difficulties arise, at least in part to, because sound waves, which are used for ultrasonic inspection, can be partially reflected from grains, and represent a background "noise." The generated background noise can mask flaws in the material, and is thus undesirable.

Ultrasonic inspection techniques have been developed that use focused ultrasonic beams to enhance a flaw fraction within any instantaneously insonified volume of material. These developed ultrasonic inspection techniques can identify indications based both on maximum signal, as well as signal to noise. The scattering of sound in a polycrystalline metallic material body, which is also known in the art as attenuation of a propagating sound wave, can be described as a function of at least one of the following: grain dimensions, intrinsic material characteristics, and ultrasound frequency. Typically, three different functional relationships among scattering, frequency, and grain dimensions have been described. These are:

for $\lambda > 2\ \pi D$, $a = Tv^4\Theta$, termed "Rayleigh" scattering;

for $\lambda < 2\ \pi D$ or $\lambda \cong D$, $a = Dv^2\Sigma$, termed "stochastic" or "phase" scattering; and for $\lambda << D$, a 1/D, termed "diffusion" scattering;

where a is the attenuation, $\lambda$ is the wavelength of the ultrasound energy, v is the frequency of the ultrasound energy, D is an average grain diameter, T is a scattering volume of grains, and $\Theta$ and $\Sigma$ are scattering factors based on elastic properties of the material being inspected.

The microstructure of a material can determine the applications in which the material can be used, and the microstructure of a material can limit the applications in which the material can be used. The microstructure can be evaluated by measuring the scattering of sound waves in a material. The scattering of sound in a material, such as titanium, is sensitive to its microstructure. The titanium microstructure's sound scattering sensitivity can be attributed to $\alpha$Ti particles that are arranged into "colonies." These colonies typically have a common crystallographic (and elastic) orientation, and these colonies of $\alpha$Ti particles can behave as large grains in the titanium material. An individual $\alpha$Ti particle might be about 5 $\mu$m in diameter, however, a colony of $\alpha$Ti particles could be greater than about 200 $\mu$m in diameter. Thus, the size contribution attributed to sound scattering sensitivity from $\alpha$Ti particles could vary over 40-fold among differing microstructures. Additionally, the sound scattering sensitivity due to $\alpha$Ti particles could change between that from randomly oriented $\alpha$Ti particles to that from $\alpha$Ti particles within oriented colonies of $\alpha$Ti particles.

Colony structures are formed during cooling a titanium alloy from a high temperature as $\beta$Ti transforms to $\alpha$Ti. There is a crystallographic relation between the $\alpha$Ti and the parent $\beta$Ti grain, such that there are only three crystallographic orientations that $\alpha$Ti will take when forming from a given $\beta$Ti grain. If the cooling rate is high and there is uniform nucleation of $\alpha$Ti throughout the grain, neighboring $\alpha$Ti particles have different crystallographic orientations, and each behave as distinct acoustic scattering entities. However, if there are only a few sites of $\alpha$Ti nucleation within the $\beta$Ti grain, then the $\alpha$Ti particles in a given area all grow with the same crystallographic orientation, and a colony structure results. This colony becomes the acoustic entity. Since a colony is formed within a $\beta$Ti grain, the colony size will be no larger than the $\beta$Ti grain size. The size of $\beta$Ti grains and the nature of $\alpha$Ti particles colony structures are important variables that influence ultrasonic noise and ultrasonic inspection in single phase and two-phase titanium alloys and materials. Therefore, the size of $\beta$Ti grains and the nature of $\alpha$Ti particles in colony structures may influence ultrasonic inspection techniques, methods, and results by creating undesirable noise during ultrasonic inspection. While thermomechanical processing techniques, which rely on dynamic recrystallization in at least one of the $\beta$ and the $\alpha+\beta$ temperature ranges to achieve uniform fine grain (UFG) $\alpha$Ti particles and prevent colony formation, have been developed to improve titanium microstructure, defects may remain in the titanium material. These defects may be undesirable for some titanium material applications, particularly those that are fatigue-life limiting applications.

There are a number of patents directed to ultrasonic inspection titanium alloys. For example, U.S. Pat. No. 5,631,424, entitled "Method For Ultrasonic Evaluation Of Materials Using Time Of Flight Measurements" issued to Nieters et al, and U.S. Pat. No. 5,533,401, entitled "Multizone Ultrasonic Inspection Method And Apparatus" issued to Gilmore, and assigned to General Electric, the entire contents of which are fully incorporated by reference herein. The ultrasonic inspection results for titanium, as described in these patents, may be dependent on the processing of the titanium and its structural configurations. Various processing methods for titanium and some structural configurations may result in generated noise during ultrasonic inspection, such as, but not limited to, generated high-ultrasonic noise, and may not provide desirable ultrasonic inspection results.

The high-ultrasonic noise that is generated during ultrasonic inspection of titanium-containing articles is undesirable. The generated noise can present problems in determining acceptable titanium microstructures, as the noise can lead to at least one of, but not limited to, a reduced possibility of detecting defects, increased ultrasonic inspection times, increased part inventory, and, possibly titanium parts needing to be scrapped because they can not be accurately inspected.

Therefore, a need exists for titanium processing and formation methods that can provide ultrasonic inspection of the formed titanium with reduced noise. Further, a need exists for titanium processing and formation methods that provide enhanced ultrasonic inspection of the formed titanium, in which the titanium comprises large diameter articles, such as titanium forgings.

SUMMARY OF THE INVENTION

Accordingly, a method is set forth for processing titanium into a titanium article, in which the titanium exhibits enhanced ultrasonic inspection characterization for determining its acceptability in microstructurally sensitive titanium applications. The method for processing titanium comprises providing titanium at a temperature above its β-transus temperature; quenching the titanium from a temperature above the β-transus temperature, the step of quenching titanium forming fine grain α-plate microstructure in the titanium; and deforming the quenched titanium into a titanium article, the step of deforming the quenched titanium transforming the α-plate microstructure into discontinuous-randomly textured α particles. The discontinuous-randomly textured cc particles lead to a reduction in ultrasonic noise during ultrasonic inspection.

In another aspect of the invention, a method for processing titanium into a titanium article is provided. The method provides titanium that exhibits enhanced ultrasonic inspection results for determining its acceptability in microstructurally sensitive titanium applications. The method for processing titanium comprises providing titanium at a temperature above its β-transus temperature; quenching the titanium from a temperature above the β-transus temperature, in which the step of quenching titanium forming fine grain α-plate microstructure in the titanium without colonies; and deforming the quenched titanium into a titanium article by applying a compressive strain to the water-quenched titanium, the step of applying a compressive strain transforming the α-plate microstructure into discontinuous-randomly textured α particles. The discontinuous-randomly textured α particles lead to a reduction in ultrasonic noise during ultrasonic inspection, the discontinuous-randomly textured α particles comprise grains sizes less than about 10 μm, and the method reduces defects in the titanium microstructure following the step of deforming.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

Figure 1:
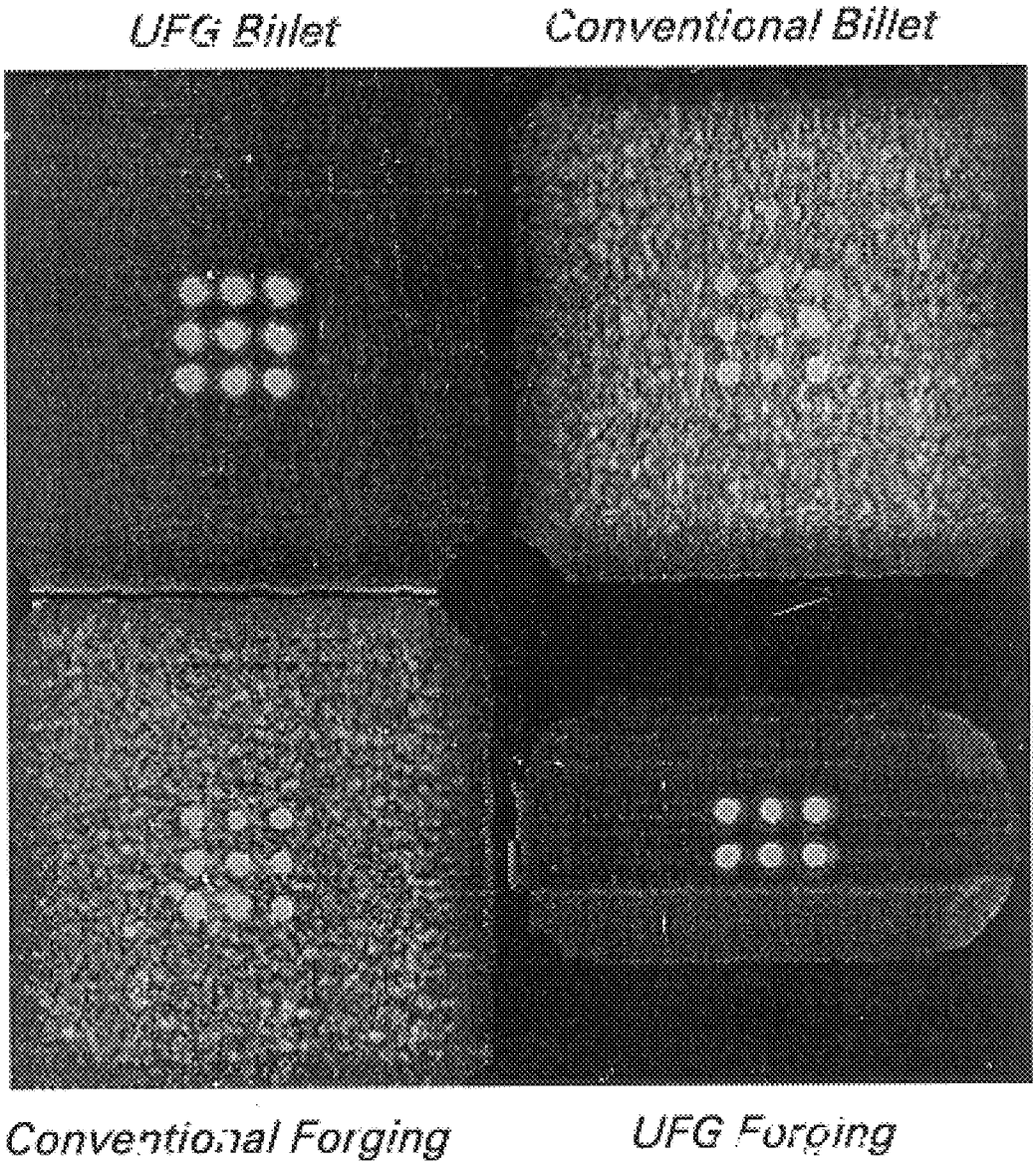
FIG. 1 is a series of C-scan micrographs that illustrate back-scattered generated ultrasonic inspection noise at about 5 MHz from titanium blocks, in which the C-scans are taken during ultrasonic inspection of a conventional titanium-6242 billet (upper right), a conventional titanium-6242 forging (lower left), a uniform fine grain (UFG) processed titanium-6242 billet (upper left), and a UFG titanium-6242 forging (lower right), each comprising 38 mm thick blocks containing 0.8 mm diameter flat bottom holes drilled to a depth of 25 mm below a top surface of the block.

A titanium processing method, as embodied by the invention, can be used to form titanium articles that exhibit reduced generated ultrasonic noise during ultrasonic inspection. The reduced generated ultrasonic noise (hereinafter "noise") is evident in titanium-containing forgings, titanium billets, titanium mults, and titanium alloy-containing forgings (hereinafter collectively referred to as "titanium forgings) that are formed by the titanium processing method, as embodied by the invention. The titanium processing method can be applied to various titanium alloys, such as, but not limited to, at least one of Ti-64, Ti-17, Ti-6242, Ti-6242S, and Ti-6246.

The titanium processing method forms titanium forgings that can be inspected using appropriate ultrasonic inspection methods and systems. Alternatively, the ultrasonic inspection can be performed on forgings of titanium articles that have been processed according to the titanium processing method, as embodied by the invention. The ultrasonic inspection determines if the titanium comprises an acceptable microstructure for forming large-scale hot-forged and hot-formed titanium-containing titanium forgings, in which the titanium forgings can be used in turbine component applications. Acceptable titanium typically comprises minimal amounts of detrimental titanium defects, which means that the amounts of defects do not adversely impact the titanium applications. These titanium defects include, but are not limited to, cracks, hard alpha regions, undesirably large grains, undesirable titanium colony structures, impurities, microstructural flaws, and other such defects in titanium (hereinafter referred to as "defects"). Titanium forgings, if determined to have acceptable titanium microstructures can be used to form various titanium articles, such as but not limited to, turbine components, including, but not limited to, turbine disks, turbine wheels, and turbine blades, for use in at least one of aircraft, jet, land-based, and marine turbine components. The above lists are merely exemplary of the features within the scope of the invention, and are not intended to limit the scope of the invention in any manner.

The titanium processing method comprises a thermomechanical processing treatment step. The thermomechanical processing treatment step can comprise quenching of a titanium article. The quenching of the titanium article can comprise any appropriate quenching process, such as, but not limited to, water-quenching, salt water-quenching, forced air-quenching, helium quenching, polymer-quenching, combination processes thereof and other such quenching processes. The following description will refer to water-quenching for discussion purposes, and is not intended to limit the invention in any manner, titanium article can comprise a large diameter article, such as greater than about 200 mm, for example greater than 250 mm. The titanium article can comprise a large, diameter titanium axially symmetric titanium ingot or billet.

The water-quenching reduces the temperature of titanium from a temperature that is above the titanium beta (β)-transus temperature. This water-quenching step, as embodied by the invention, results in a fine alpha plate (α-plate) microstructure (also known as a "transformed β" microstructure) being formed in the titanium article. The thickness of the alpha plates will set a lower bound on the αTi particle diameters achieved by subsequent thermomechanical processing. The need for this quenching step is to achieve alpha plate thicknesses less than about 5 μm, so that final αTi particle diameters will be 5 μm or less.

The titanium processing method further comprises a step that includes deforming the water-quenched titanium article. The step of deforming the water-quenched titanium article can comprises appropriate metallurgical deformation processes. The deformation process deforms the water-quenched titanium article to a sufficient degree so alpha plates are transformed into discontinuous, randomly textured particles. This transformation from alpha plates into discontinuous, randomly textured particles forms an α-titanium microstructure that can comprise grain sizes less than about 10 μm, for example, but not limited to, 5 μm.

The transformation can be part of the deforming step in thermomechanical processing treatment of the titanium processing method, as embodied by the invention. Alternatively, the transformation from alpha plates into discontinuous, randomly textured particles can comprise a subsequent annealing step of the titanium article in a titanium processing method, as embodied by the invention.

The deformation can comprise the application of a compressive strain, for example, but not limited to an axially compressive strain. The compressive strain can be applied by any appropriate strain-applying device, and the strain rate can be provided in a range from about $10^{-4}$ s−1 to about $10^{-2}$ $s^{-1}$. For example, and in no way limiting of the invention, the compressive strain may be applied in strain rate ranges from about $10^{-3}$ s−1 to $10^{-2}$ $s^{-1}$. Further, compressive strains that are typically greater than about 30%, or greater for individual deformation steps during multiple deformation step processes, can be used for the compressive strain. Compressive strains that are greater than about 50% can also be used, for example, compressive strain that is greater than about 70% can be applied to the titanium article.

The titanium processing method, as embodied by the invention, is generally performed using thermomechanical processing treatment conditions in which shear banding may occur. It is necessary to avoid shear banding, because conditions at which the shear banding occurs may damage the formed homogenous fine-grain titanium microstructures. Typically, processing conditions, as embodied by the invention, may be conducted in an α-β titanium field at temperatures that correspond to a volume fraction of predominately α titanium. For example, but not limiting the invention, the volume fraction can be provided in a range from about 0.3 to about 0.7.

After the applying of compressive strains, the titanium article may be subjected to a secondary metallurgical operation. The secondary metallurgical operation may comprise a forming operation, for example, but not limited to, drawing back the titanium article to its initial dimensions. Alternatively, the secondary metallurgical operation may transform the titanium article to any other dimension. The secondary metallurgical operation may prepare the titanium article for forging. The secondary drawing operation can be performed by any appropriate metallurgical operation, such as, but not limited to, extrusion through a large die and/or sequential radial forging operations on an outer diameter of the titanium article. Extrusion through a large die may require a large extrusion press, and strain rates may not be accurately controllable during break though of the initial extrusion. Further, the secondary metallurgical operation may comprise an α-β heat treatment that follows a final forging operation.

The titanium processing method, as embodied by the invention, forms a fine grain microstructure in the titanium that can lead to reductions in both ultrasonic noise and also the attenuation, each of which can be generated during ultrasonic inspection. Therefore, the titanium processing method forms titanium with enhanced ultrasonic inspectability and an increased probability for the detection of defects. The titanium processing method, as embodied by the invention, can be used to form large diameter titanium articles, such as titanium articles with diameters greater than about 150 millimeters (mm), including, but not limited to, greater than about 250 mm. This titanium processing method forms titanium articles with an enhanced ultrasonic inspection capability compared to ultrasonic inspection of conventionally-formed titanium. In the ultrasonic inspection of conventionally-formed titanium, a titanium billet is typically thermo-mechanically processed to small diameters articles, often less than about 150 mm, for adequate ultrasonic inspectability potential and characteristics.

Figure 2:
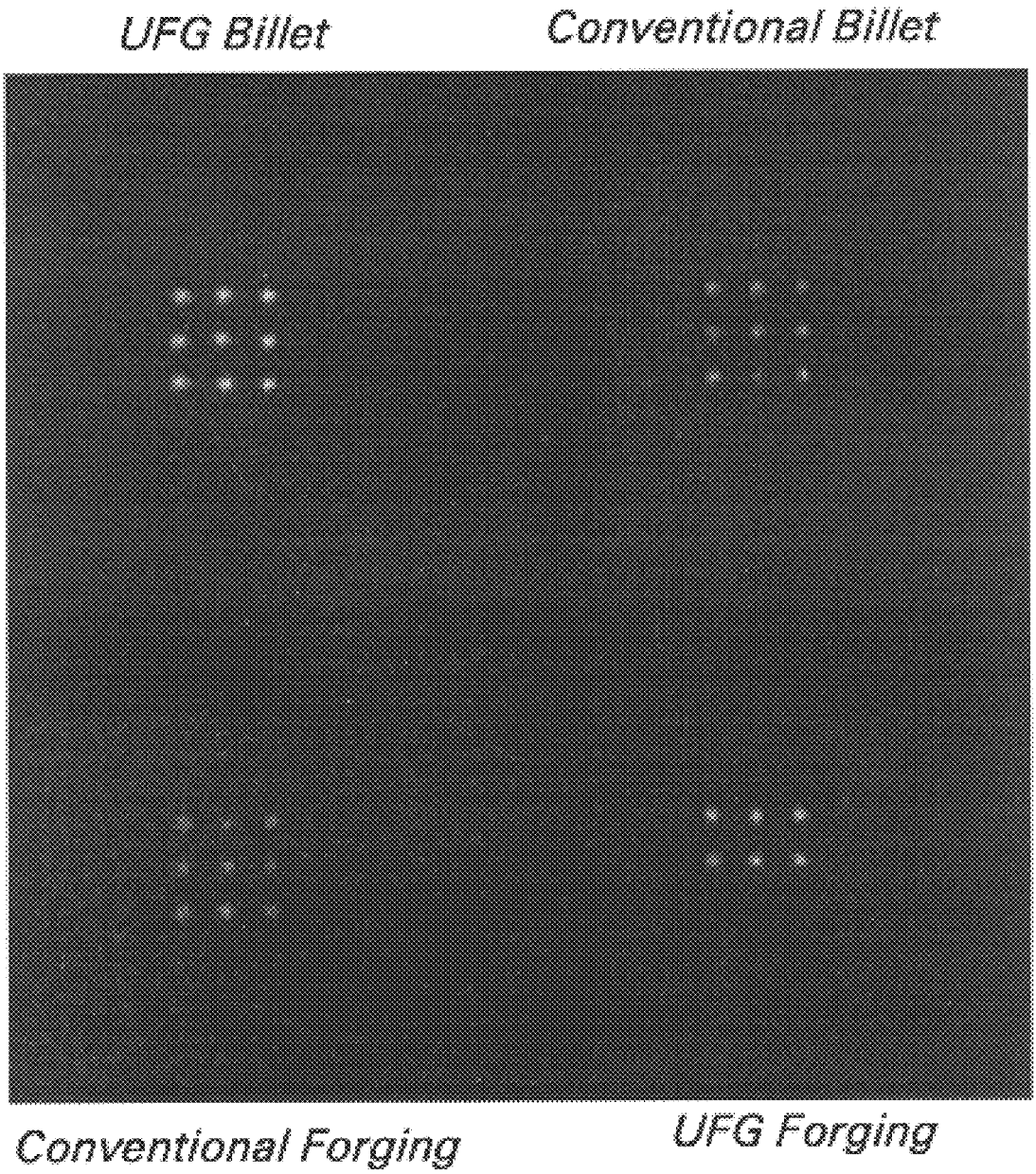
FIG. 2 is a series of C-scan micrograph that illustrates signals from holes at about 5 MHz of titanium blocks taken during ultrasonic inspection of a conventional titanium-6242 billet (upper right), a conventional titanium-6242 forging (lower left), a uniform fine grain (UFG) processed titanium-6242 billet (upper left), and a UFG titanium-6242 forging (lower right), each comprising 38 mm thick blocks containing 0.8 mm diameter flat bottom holes drilled to a depth of 25 mm below a top surface of the block.

The enhanced ultrasonic inspectability of titanium articles with uniform fine grains is demonstrated in the C-scans of FIG. 1. FIG. 1 is a series of C-scan micrographs that illustrate back-scattered generated ultrasonic inspection noise at about 5 MHz from titanium blocks. The C-scans are taken during ultrasonic inspection of a conventional titanium-6242 billet (upper right), a conventional titanium-6242 forging (lower left), a uniform fine grain (UFG) processed titanium-6242 billet (upper left), and a UFG titanium-6242 forging (lower right), each comprising 38 mm thick blocks containing about 0.8 mm diameter flat bottom holes drilled to a depth of 25 mm below a top surface of the block. The titanium-6242 blocks were provided with approximate dimensions of 50 mm×50 mm×38 mm. The UFG titanium-6242 forging comprises smaller dimensions, however these dimensions are not believed to influence the ultrasonic inspection of the titanium article. FIG. 2 is a similar series of C-scan micrographs with an ultrasonic signal from the flat bottom holes (synthetic flaws).

Flat bottom holes, which are machined in each block, provide synthetic flaws that provide a well-defined acoustic reflectance for ultrasonic inspection reference purposes. For a conventional titanium-6242 billet and forging, and an UFG titanium-6242 billet, nine flat bottom holes, which were about 0.8 mm in diameter, were machined in the titanium blocks to a depth of 25 mm below its top surface. Only such 6 holes were machined in the UFG titanium-6242 titanium block.

In FIG. 1, the gain from the ultrasonic inspection is set to amplify the generated noise, and the ultrasonic information was filtered in time of flight measurements to exclude signals from the holes. In FIG. 1, the dark regions represent low noise and light regions represent high noise regions of the titanium block. These C-scans indicate that a conventionally forged titanium-6242 billet possesses higher ultrasonic noise levels than both a UFG titanium-6242 billet and forged UFG titanium-6242.

The ultrasonic signals from the flat bottom holes are illustrated in FIG. 2. The C-scan data are filtered in time of flight measurements to a depth of about 25 mm below a top surface of the titanium block to select only the tips of the flat bottom holes. The C-scans illustrate that signals from the flat bottom holes are typically larger in the UFG titanium-6242 and forged UFO titanium-6242 than in the titanium-6242 forging. These C-scan results suggest that attenuation of the signal from the flat bottom holes is less in the UFG titanium-6242 billet and forging.

Figure 3:
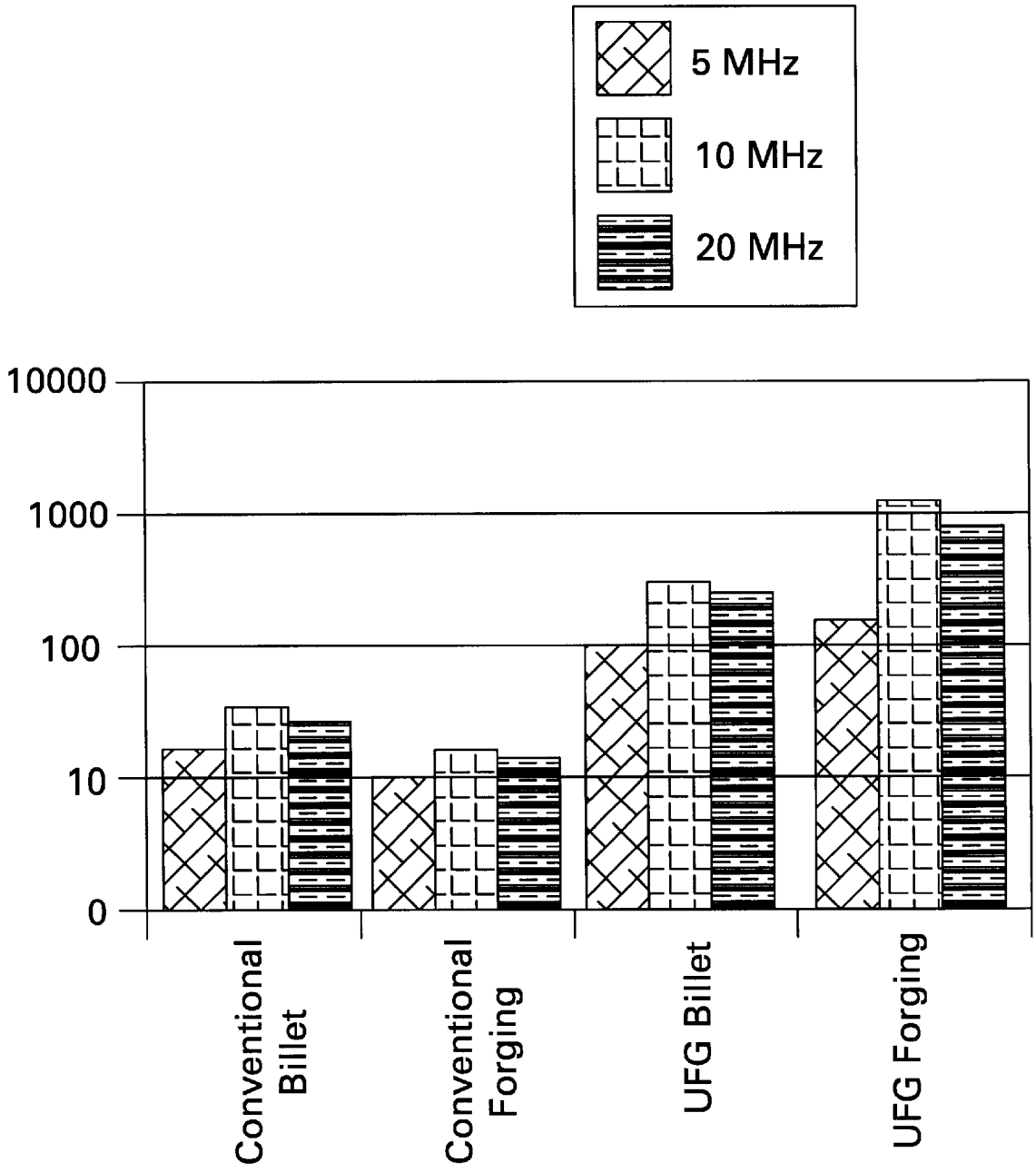
FIG. 3 is a chart that illustrates generated signal to noise ratios during ultrasonic inspection from 0.8 mm diameter flat bottom holes in the titanium blocks of FIGS. 1 and 2.

FIG. 3 is a graph that illustrates a signal to noise ratio from the holes from the titanium block samples in FIGS. 1 and 2. The signal to noise ratios for the flat bottom holes in the UFG titanium-6242 and forged UFG titanium-6242 are about 20 dB higher than the signal to noise ratio for the flat bottom holes in the conventionally processed titanium-6242.

Both the UFG titanium-6242 and forged UFG titanium-6242 possess homogeneous macrostructures and microstructures. Electron back scattering pattern analysis indicates that the UFG titanium-6242 billet and forging are essentially free of any crystallographic texture, in which the term "essentially" means that crystallographic texture did not develop to a degree in which it adversely impacts ultrasonic inspection. Further, as confirmed by these ultrasonic inspection results, the UFG titanium-6242 billet and forging possesses a fine uniform primary α titanium grain size of about 10 μm or less. The fine uniform primary α titanium grain size and absence of adverse crystallographic texture, such as, but not limited to, large β-colony-sized grains, are responsible for low ultrasonic noise generated during ultrasonic inspection and high inspectability characteristics.

Accordingly, the titanium processing method, as embodied by the invention, provides a formation process for titanium and titanium-containing articles, in which the ultrasonic inspection of these articles can accurately detect defects. The titanium processing method allows for ultrasonic inspection to determine titanium and titanium-containing articles that can be used as turbine components, such as, but not limited to billets, disks or airfoils.

While various embodiments are described herein, it will be appreciated from the specification that various combinations of elements, variations or improvements therein may be made by those skilled in the art, and are within the scope of the invention.

We claim:

1. A method for processing titanium into a titanium article, in which the titanium exhibits enhanced ultrasonic inspection results for determining its acceptability in microstructurally sensitive titanium applications, the method for processing titanium comprising:

providing titanium at a temperature above its β-transus temperature;

quenching the titanium from a temperature above the β-transus temperature to form a microstructure in the titanium comprising an α-plate phase having a hexagonal close packed crystal structure, where the α-plates have thicknesses of less than 10 μm; and deforming the quenched titanium into a titanium article, wherein the step of deforming the quenched titanium transforms the α-plate microstructure into discontinuous-randomly textured α particles without colonies, wherein the discontinuous-randomly textured α particles without colonies lead to a reduction in ultrasonic noise during ultrasonic inspection.

2. A method according to claim 1, wherein the discontinuous-randomly textured α particles comprise grain sizes less than about 5 μm.

3. A method according to claim 1, wherein the method increases the detectability of defects in the titanium microstructure following the step of deforming.

4. A method according to claim 3, wherein the defects that can be detected include cracks, hard alpha regions, undesirably large grains, undesirable titanium colony structures, impurities, or microstructural flaws.

5. A method according to claim 1, wherein the step of deforming comprises applying an axial compressive strain to the quenched titanium.

6. A method according to claim 5, wherein the step of applying an axially compressive strain comprises applying an axial compressive strain at a strain rate in a range from about $10^{-4}s^{-1}$ to about $10^{-2}s^{-1}$.

7. A method according to claim 5, wherein the step of applying an axially compressive strain comprises applying an axial compressive strain at a strain rate in a range from $10^{-3}s^{-1}$ to about $10^{-2}s^{-1}$.

8. A method according to claim 5, wherein the step of applying an axial compressive strain comprises applying strain at a strain greater than about 30%.

9. A method according to claim 5, wherein the step of applying an axial compressive strain comprises applying strain at a strain greater than about 50%.

10. A method according to claim 5, wherein the step of applying an axial compressive strain comprises applying strain at a strain greater than about 70%.

11. A method according to claim 1, the step of deforming the quenched titanium comprises applying an axial compressive strain, and the method further comprising:

applying a forming operation and heat treatment on the titanium article.

12. A method according to claim 11, the step of applying a forming operation and heat treatment comprises drawing the titanium after the step of applying an axial compressive strain.

13. A method according to claim 11, the step of applying a forming operation and heat treatment comprises extruding the titanium after the step of applying an axial compressive strain.

14. A method according to claim 1, wherein the titanium article comprises a diameter greater than about 150 millimeters.

15. A method according to claim 14, wherein the titanium article comprises a diameter greater than about 250 mm.

16. A method according to claim 1, wherein the titanium article comprises a turbine component.

17. A method according to claim 1, wherein the step of quenching comprises water-quenching.

18. A method according to claim 1, wherein the step of quenching comprises quenching by at least one of:

water-quenching, salt water-quenching, forced air-quenching, helium quenching, polymer-quenching, and combinations thereof.

19. A method for processing titanium into a titanium article, in which the titanium exhibits enhanced ultrasonic inspection characteristics for determining its acceptability in microstructurally sensitive titanium applications, the method for processing titanium comprising:

providing titanium at a temperature above its β-transus temperature;

quenching the titanium from a temperature above the β-transus temperature to form a microstructure in the titanium without colonies, the two phase microstructure comprising an α-plate phase having a hexagonal close packed crystal structure, where the α-plate thickness is less than 10 μm; and deforming the quenched titanium into a titanium article by applying an axial compressive strain to the quenched titanium, wherein the step of applying an axial compressive strain transforms the α-plate microstructure into discontinuous-randomly textured α particles without colonies;

wherein the discontinuous-randomly textured α particles without colonies lead to a reduction in ultrasonic noise during ultrasonic inspection, the discontinuous-randomly textured α particles comprise grains sizes less than about 10 μm.

* * * * *